US006906737B2

(12) United States Patent
Ito et al.

(10) Patent No.: US 6,906,737 B2
(45) Date of Patent: Jun. 14, 2005

(54) THERMAL DEVELOPING APPARATUS

(75) Inventors: Tomohiko Ito, Kanagawa (JP); Nobuyuki Torisawa, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 117 days.

(21) Appl. No.: 10/400,587

(22) Filed: Mar. 28, 2003

(65) Prior Publication Data

US 2003/0214570 A1 Nov. 20, 2003

(30) Foreign Application Priority Data

Mar. 29, 2002 (JP) ..... P. 2002-096414

(51) Int. Cl.[7] ..... B41J 2/32
(52) U.S. Cl. ..... 347/197
(58) Field of Search ..... 347/197, 171–172, 347/174–177, 213, 215, 221, 140, 156, 220, 228; 400/120.01, 120.02, 120.04

(56) References Cited

U.S. PATENT DOCUMENTS 4,916,486 A * 4/1990 Nakatani ..... 399/1
5,410,335 A * 4/1995 Sawano et al. ..... 347/172

* cited by examiner

*Primary Examiner*—K. Feggins
(74) *Attorney, Agent, or Firm*—Sughrue Mion, PLLC

(57) ABSTRACT

A thermal developing apparatus having a recording section 16 for exposing a thermal developing photosensitive material or a photosensitive thermal recording material (hereinafter referred to as a "thermal developing recording material") to form a latent image, a control section A for controlling the recording section 16, and a thermal developing section 18 for heating the thermal developing recording material by a heating member to carry out thermal development, comprising a sensor B1 for measuring the surface temperature of a presser roller of the thermal developing section 18 and a light amount correcting circuit A1 for correcting an amount of recording light of the thermal developing recording material based on the output of the sensor B1, the amount of light of the light amount correcting circuit A1 being corrected to reduce the amount of light when the surface temperature of the presser roller is raised.

10 Claims, 10 Drawing Sheets

FIG. 10

| | | TEMPERATURE OF DEVELOPING SECTION (°C) | | | | | | |
|---|---|---|---|---|---|---|---|---|
| | | · · · | 96 | 97 | 98 | 99 | 100 | · · · |
| IMAGE DENSITY | 0 | · · · | 1.17 | 1.15 | 1.13 | 1.11 | 1.09 | · · · |
| | 1 | | 1.19 | 1.18 | 1.15 | 1.13 | 1.11 | |
| | 2 | | 1.23 | 1.20 | 1.17 | 1.15 | 1.13 | |
| | 3 | | 1.25 | 1.22 | 1.19 | 1.17 | 1.15 | |
| | 4 | | 1.27 | 1.24 | 1.21 | 1.19 | 1.17 | |
| | 5 | | 1.29 | 1.26 | 1.24 | 1.23 | 1.19 | |
| | 6 | | 1.31 | 1.28 | 1.27 | 1.25 | 1.21 | |
| | 7 | | 1.33 | 1.30 | 1.29 | 1.27 | 1.23 | |
| | 8 | | 1.35 | 1.32 | 1.31 | 1.29 | 1.25 | |
| | 9 | | 1.37 | 1.36 | 1.33 | 1.31 | 1.27 | |
| | 10 | | 1.39 | 1.38 | 1.35 | 1.33 | 1.29 | |
| | 11 | | 1.43 | 1.42 | 1.37 | 1.35 | 1.31 | |
| | 12 | | 1.46 | 1.44 | 1.39 | 1.37 | 1.33 | |
| | 13 | | 1.48 | 1.46 | 1.42 | 1.38 | 1.35 | |
| | 14 | | 1.51 | 1.48 | 1.44 | 1.40 | 1.37 | |
| | 15 | | 1.53 | 1.50 | 1.46 | 1.42 | 1.39 | |
| | 16 | | 1.55 | 1.52 | 1.48 | 1.44 | 1.41 | |
| | 17 | | 1.57 | 1.54 | 1.49 | 1.46 | 1.43 | |
| | 18 | | 1.60 | 1.56 | 1.51 | 1.48 | 1.44 | |
| | 19 | | 1.63 | 1.58 | 1.53 | 1.50 | 1.45 | |
| | 20 | | 1.66 | 1.60 | 1.55 | 1.52 | 1.47 | |
| | 21 | | 1.69 | 1.62 | 1.57 | 1.54 | 1.48 | |
| | 22 | | 1.72 | 1.65 | 1.59 | 1.56 | 1.50 | |
| | 23 | | 1.75 | 1.68 | 1.62 | 1.58 | 1.52 | |

THERMAL DEVELOPING APPARATUS

BACKGROUND OF THE INVENTION

1. Field of the Invention

The present invention relates to a thermal developing apparatus using a heat treatment device for carrying out a heat treatment for a thermal developing recording material to be heat treated and utilizing a dry material over which a wet process is not carried out.

2. Description of the Related Art

As an image recording apparatus for recording an image for a medical treatment such as a digital radiography system, a CT or an MR, conventionally, there has been used a wet system for carrying out photographing or recording over a silver salt photographic type photosensitive material and then performing a wet process to obtain a reproduced image.

On the other hand, recently, attention has been paid to a recording apparatus using a dry system which does not carry out a wet process. In such a recording apparatus, a film formed of a photosensitive or thermal recording material (a photosensitive thermal recording material) or a thermal developing photosensitive material (which will be hereinafter referred to as a "thermal developing recording material") has been used. In the recording apparatus using a dry system, moreover, a laser beam is irradiated (scanned) on the thermal developing recording material to form a latent image in an exposing section and the thermal developing recording material is then caused to come in contact with heating means to carry out thermal development in a thermal developing section, and cooling is thereafter performed and the thermal developing recording material having an image formed thereon is discharged out of the apparatus.

In such a dry system, it is possible to solve a problem of a waste water process as compared with the wet process.

As a result of the investigations of such a conventional thermal developing apparatus, however, the temperature of the thermal developing section is gradually changed by an ambient temperature and the continuous process of a thermal developing recording material. Consequently, it has been found that the density of an image gradually fluctuates. More specifically, when the ambient temperature is raised, the temperature of the thermal developing section is raised. Moreover, the temperature of the thermal developing section is also raised by the continuous process of the thermal developing recording material. For this reason, the density of the image becomes higher than a predetermined density.

FIG. 2 is a chart showing the transition of a temperature versus a time at a certain point on a thermal developing recording material while thermal developing recording materials A and B enter and get out of the thermal developing section. In FIG. 2, an axis of ordinate indicates a temperature and Ts indicates a thermal developing start temperature. The thermal development is not started at a thermal developing start temperature which is less than Ts. The thermal development is started to progress at a thermal developing start temperature which is equal to or higher than Ts. An axis of abscissa indicates a time. Both A and B indicate thermal developing recording materials. The thermal developing recording material A passes through the thermal developing section in which a temperature obtained immediately after the start of an operation is not raised completely and the thermal developing recording material B passes through the thermal developing section in which the temperature is raised by a continuous operation for a long period of time. The thermal developing recording material A on which a latent image is recorded in a recording section at a former stage enters the thermal developing section through a transfer section and is thus heated, and the development progress temperature Ts is reached at a time $t_{10}$ and the development progress is started. Then, the temperature of the thermal developing recording material A is raised and is maintained to be constant by a warm tone at the development progress temperature or more, and the thermal developing recording material A gets out of the thermal developing section and moves to a next cooling section. At a time $t_{11}$ in the middle, the temperature reaches a temperature which is less than the development progress temperature Ts. Consequently, the thermal development progress is stopped.

In this case, a development progress time tA of the thermal developing recording material A is expressed in an equation 1.

$$tA=t_{11}-t_{10} \quad \text{(Equation 1)}$$

However, when the operation of the apparatus progresses, the temperature of the thermal developing section is raised by a rise in the ambient temperature and the continuous process of the thermal developing recording material. Consequently, the thermal developing recording material B does not reach the development progress start temperature Ts at a time $t_{20}$ but the time $t_{10}$. Moreover, if the thermal development progress stops at the same time $t_{11}$, a development progress time tB of the thermal developing recording material B is expressed in an equation 2.

$$tB=t_{11}-t_{20} \quad \text{(Equation 2)}$$

As a result of comparison between the equations 1 and 2, the development progress time of the thermal developing recording material B is increased by a difference Δt of tB−tA. Accordingly, the density of an image is increased correspondingly.

Furthermore, the conventional printer of this type has a mechanism requiring heat-up. Accordingly, a print process is not executed until predetermined heat-up is completed. On the other hand, a printer is to be used urgently in a hospital in some cases. In those cases, even if picture quality is slightly deteriorated, a diagnosis can be often carried out sufficiently if an intermediate density portion appears. For example, it is sufficient that an X-ray film taken when an infant swallows a foreign matter by mistake can urgently specify the place of the foreign matter, and it is not necessary to wait for the heat-up until picture quality having high precision can be obtained. A thermal recording printer described in JP-A-7-125295 serves to carry out prediction such that a temperature reaches a predetermined temperature immediately before a sheet comes to a fixing section, thereby performing an estimated start, and persistently predicts a development enabling temperature. Therefore, only a time taken for the sheet to reach the fixing section can be saved and a considerable time cannot be saved in case of emergency described above.

SUMMARY OF THE INVENTION

According to the invention, the invention has an object to prevent the density of an image from being changed even if the temperature of a thermal developing section is raised.

Furthermore, in case of emergency in which there is not a moment to lose and when such picture quality as to specify the position of a foreign matter is enough, moving-up recording can be carried out at the sacrifice of such picture quality.

In order to solve the problem, a first aspect of the invention is directed to an image recording method of a thermal developing apparatus having a recording section for exposing a thermal developing recording material to form a latent image, a control section for controlling the recording section, and a thermal developing section for heating the thermal developing recording material by a heating member to carry out thermal development, comprising the steps of measuring a temperature of the thermal developing section and correcting an amount of recording light of the thermal developing recording material of the recording section and/or a temperature of the heating member of the thermal developing section based on a temperature of the thermal developing section.

A second aspect of the invention is directed to a thermal developing apparatus having a recording section for exposing a thermal developing recording material to form a latent image, a control section for controlling the recording section, and a thermal developing section for heating the thermal developing recording material by a heating member to carry out thermal development, comprising a thermal developing section temperature sensor for measuring a temperature of the thermal developing section, and a light amount correcting circuit for correcting an amount of recording light of the thermal developing recording material of the recording section and/or a heating member temperature correcting circuit for correcting a temperature of the heating member of the thermal developing section.

In addition, an improvement in the second aspect of the invention is directed to the thermal developing apparatus comprising a presser roller for causing the thermal developing section to press the thermal developing recording material against the heating member, wherein the thermal developing section temperature sensor serves to detect a surface temperature of the presser roller.

Similarly, the improvement in the second aspect of the invention is characterized in that a correction of a light amount of the light amount correcting circuit more reduces the amount of light when a temperature detected by the thermal developing section temperature sensor is higher.

By the structure described above, the temperature of the thermal developing section is measured and the amount of recording light of the thermal developing recording material and/or the temperature of the heating member are/is corrected based on the measured value. Consequently, a density can be always maintained to be constant even if the thermal developing section is changed to have various temperatures.

A third aspect of the invention is directed to an image recording method of a thermal developing apparatus comprising a recording section for exposing a thermal developing recording material to form a latent image, a control section for controlling the recording section, and a thermal developing section for heating the thermal developing recording material by a heating member to carry out thermal development, wherein in the case in which a temperature of the thermal developing section does not reach a predetermined developing start temperature (hereinafter referred to as "heat-up uncompletion") and the temperature of the thermal developing section which can give a sufficient density for a diagnosis has already been reached or the temperature of the thermal developing section which is enough for the diagnosis can be expected to be reached at time of development, image recording can be executed in response to an instruction of a user.

By the structure described above, in the case in which it is sufficient that an image enough for the diagnosis can be obtained at the sacrifice of picture quality in an emergency in which there is not a moment to lose, the recording can be moved up and a time can be saved more greatly as compared with the conventional apparatus.

A fourth aspect of the invention is directed to the image recording method of a thermal developing apparatus according to the third aspect of the invention, wherein a correction for increasing an amount of exposure by the recording section is carried out corresponding to a reduction in a density which is caused by the heat-up uncompletion.

By the structure described above, a difference in a density is given to the recorded image so that it is possible to obtain an image which can be seen more easily at time of the heat-up uncompletion.

A fifth aspect of the invention is directed to the image recording method of a thermal developing apparatus according to the third or fourth aspect of the invention, wherein a display indicative of image recording at time of the heat-up uncompletion is given to a film output as a result of the image recording started at time of the heat-up uncompletion.

By the structure described above, the purport that the image recording is carried out at time of the heat-up uncompletion is recorded on the film. Consequently, a person himself (herself) and a third person can know that the image recording is carried out at time of the heat-up uncompletion and the printing is therefore performed with an agreement of a deterioration in picture quality. Consequently, the person himself (herself) can be prevented from memorizing the purport for future reference. Furthermore, the third person who does not know the purport can be prevented from excessively worrying about the failure of the developing apparatus when he (she) sees the film.

Furthermore, an improvement in the third aspect of the invention is characterized in that the image recording started at time of the heat-up uncompletion can be finally reoutput after predetermined heat-up is completed. In this case, (A) the reoutput may be carried out automatically or (B) a user may be asked about the reoutput and the reoutput may be carried out when a request for the reoutput is given from the user.

By the structure described above, an emergent film can be obtained at time of the heat-up uncompletion, and furthermore, an original film of high quality can be obtained for future reference, which is convenient.

In any invention, thus, the temperature of the developing section is measured to correct the amount of exposure of the exposing section. In the former embodiment, the overheat of the temperature of the developing section is predicted to correct the amount of exposure of the exposing section. In the latter embodiment, a shortage of the temperature of the developing section is predicted to correct the amount of exposure of the exposing section. Consequently, a desirable density can be obtained even if the thermal developing section has various temperatures.

BRIEF DESCRIPTION OF THE DRAWINGS

FIG. 10 is a correction coefficient table showing each correction coefficient according to an example in case of an image density versus the temperature of the thermal developing section.

DESCRIPTION OF THE PREFERRED EMBODIMENTS

A preferred embodiment of the invention will be described below in detail with reference to the accompanying drawings.

Figure 1:
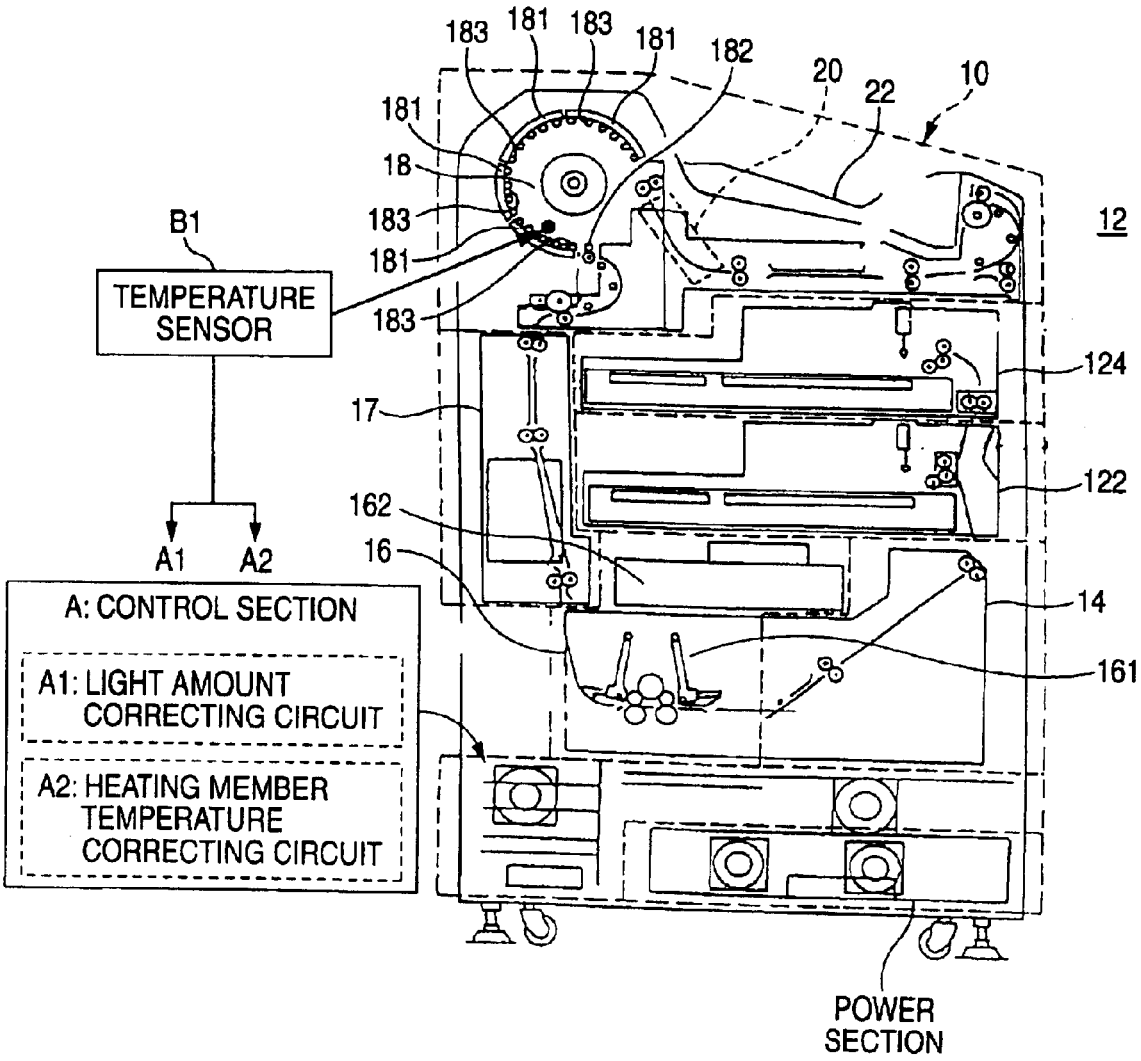
FIG. 1 is a schematic view showing a thermal developing apparatus according to an embodiment of the invention.

FIG. 1 is a schematic view showing an image forming apparatus of a dry system according to the embodiment of the invention. In FIG. 1, an image forming apparatus 10 serves to expose a thermal developing recording material and to form a latent image by scanning and exposure through a light beam L comprising a laser beam by using a thermal developing recording material which does not require a wet type developing process, to then carry out thermal development, thereby obtaining a visible image, and to thereafter perform cooling to an ordinary temperature. Accordingly, the image forming apparatus 10 basically comprises a thermal developing recording material feeding section 12, a sideways moving section (a thermal developing recording material positioning section) 14, an image exposing section (which will be hereinafter referred to as a "recording section") 16, a transfer section 17 for transferring the thermal developing recording material from the recording section 16 to a thermal developing section 18, the thermal developing section 18 and a cooling section 20 in order of the delivery direction of the thermal developing recording material.

The thermal developing photosensitive material is a thermal developing recording material for recording (exposing) an image by a light beam (for example, a laser beam) and then carrying out thermal development and coloring.

Moreover, the photosensitive thermal recording material is a thermal developing recording material for recording (exposing) an image by a light beam, then carrying out thermal development and coloring or recording and coloring the image through the heat mode (heat) of a laser beam or a thermal head and thereafter carrying out a fixation through a light irradiation.

Examples of the thermal developing photosensitive material or the photosensitive thermal recording material include the following methods:

(1) a method of superposing a photosensitive material exposed like an image on an image receiving material and heating them (and pressurizing them if necessary), thereby transferring, to the image receiving material, an image corresponding to a latent image formed on the photosensitive material by exposure (for example, methods described in JP-A-5-113629, JP-A-9-258404, JP-A-9-61978, JP-A-8-62803, JP-A-10-71740, JP-A-9-152705, JP-A-10-90181, JP-A-10-13326 and JP-A-10-18172), (2) a method of superposing a photosensitive material exposed like an image on a processing material and heating them, thereby forming, on a photosensitive material, an image corresponding to a latent image formed on the photosensitive material by exposure (for example, methods described in JP-A-9-274295 and JP-A-10-17192), (3) a method of exposing, like an image, a photosensitive material having a photosensitive layer distributing, in a binder, silver halide acting as a photocatalyst, silver salt acting as an image forming material and a reducing agent for a silver ion and then heating the photosensitive material to a predetermined temperature, thereby revealing a latent image formed by exposure (for example, "Thermally Processed Silver Systems" by B. Shely (Imaging Processes and Material) Neblette No. 8, edited by Sturge, V. Walworth and A Shepp, Page 2, 1996), Research Disclosure 17029 (1978), No. EP803764A1, No. EP803765A1 and JP-A-8-211521), and (4) a method utilizing a photosensitive thermal developing recording material, that is, a method in which a photosensitive thermal recording layer utilizes a thermal developing recording material including an electron-donating achromatic dye enclosed in a thermal responsive microcapsule, and a compound having an electron accepting section and a polymerizing vinyl monomer section in the same molecule and a photopolymerization initiator on the outside of the microcapsule (for example, a method described in JP-A-4-249251) or a method in which a photosensitive thermal recording layer utilizes a thermal developing recording material including an electron-donating achromatic dye enclosed in a thermal responsive microcapsule, and an electron accepting compound, a polymerizing vinyl monomer and a photopolymerization initiator on the outside of the microcapsule (for example, a method described in JP-A-4-211252).

The above-mentioned thermal developing recording material is usually formed into a laminated product (bundle) on a predetermined unit of 100 sheets and is packed into a package by using a bag member or a band. The package is accommodated in a magazine corresponding to each size and is loaded in each stage of the thermal developing recording material feeding section 12.

The thermal developing recording material feeding section 12 has two stages and thermal developing recording materials (for example, a B4 size and a half-cut size) having different sizes which are loaded in the respective stages are accommodated in respective inner parts 121 and 122 through the magazines and any of them can be used selectively.

Then, the following serial processing operations are executed in response to a print instruction.

First of all, one thermal developing recording material of the magazine selected by suckers 123 and 124 of a sheet-feed mechanism is taken out of an upper part with the cover of the magazine opened.

The thermal developing recording material thus taken is guided to a feeding roller pair, a delivery roller pair and a delivery guide which are positioned on a downstream in a delivery direction and is thus delivered to the sideways moving section 14 on a downstream thereof.

The sideways moving section 14 serves to align the thermal developing recording material in a direction orthogonal to a delivery direction (which will be hereinafter referred to as a lateral direction), thereby taking the alignment of the thermal developing recording material in a main scanning direction in the recording section 16 on the downstream, that is, a so-called side resist to deliver the thermal developing recording material to the recording section 16 on the downstream by means of the delivery roller pair.

A method for the side resist in the sideways moving section 14 is not particularly restricted but there are illustrated various well-known methods, for example, a method using a resist plate for abutting on one end face in the lateral direction of the thermal developing recording material to carry out positioning and pushing means such as a roller for pushing the thermal developing recording material in the lateral direction to cause the end face to abut on the resist plate, and a method using the resist plate and a guide plate which serves to control the delivery direction of the thermal developing recording material in the lateral direction to abut on the resist plate in the same manner and is movable corresponding to a size in the lateral direction of the thermal developing recording material.

The thermal developing recording material delivered to the sideways moving section 14 is aligned in the direction orthogonal to the delivery direction as described above and is then delivered to the recording section 16 on the downstream by means of the delivery roller pair.

The recording section 16 serves to expose the thermal developing recording material by light beam scanning and exposure, and includes subscanning delivery means 161 and an exposing unit 162. The exposure (recording) controls the output of a laser in accordance with image data obtained by separate photographing, scans (mainly scans) the laser and moves (subscans) the thermal developing recording material in a predetermined direction at this time.

The recording section 16 comprises a first laser beam source including a semiconductor laser for outputting a laser beam L0 having a wavelength to be a reference for recording, a collimator lens for setting a laser beam to be a parallel luminous flux, and a cylindrical lens, and furthermore, a second laser beam source including a second semiconductor laser for outputting a laser beam L1 having a different wavelength from the wavelength described above orthogonally to the direction of an optical axis, a collimator lens, and a cylindrical lens.

Light emitted from each laser beam source becomes a beam superposed in the same phase through a polarization beam splitter and is incident on a polygon mirror through a reflecting mirror, and a laser beam is polarized with a rotation thereof and is simultaneously irradiated in the main scanning direction.

Then, a driver is driven by a control section A upon receipt of the input of an image signal and the rotations of the polygon mirror and a feeding motor are controlled to scan the laser beam in the main scanning direction of the thermal developing recording material and to simultaneously feed the thermal developing recording material in the subscanning direction.

Image recording for the thermal developing photosensitive material has been described in detail in International Laid-Open No. WO95/31754 publication and International Laid-Open No. WO95/30934 publication, for example.

The thermal developing recording material having a latent image recorded thereon in the recording section 16 is subsequently delivered to the thermal developing section 18 by the transferring section 17 including a delivery roller pair.

The thermal developing section 18 serves to heat a thermal developing recording material to be heat treated which is of such a type as to apply a heat treatment, and has such a structure that a plurality of plate heaters arranged in the transfer direction of the thermal developing recording material to be a heating member 181 setting a necessary temperature for processing the thermal developing recording material are curved and are arranged like a serial circular arc.

More specifically, for the structure of a heat treating device including the plate heaters, there are provided a feeding roller 182 to be transfer means for setting each of the plate heaters to be upward convex, causing the thermal developing recording material to come in contact with the surface of the plate heater and relatively moving (sliding) the thermal developing recording material, and a pressing roller 183 for transferring heat from each plate heater to the thermal developing recording material as shown in the drawing. Thus, the tip of the thermal developing recording material to be transferred is delivered to be pressed against the plate heater 181. Consequently, the buckling of the thermal developing recording material can be prevented.

A thermal developing recording material delivery path is formed by the pressing roller 183 and the plate heater 181. By setting the thermal developing recording material delivery path to have a spacing which is equal to or less than the thickness of the thermal developing recording material, it is possible to implement a state in which the thermal developing recording material is smoothly interposed and to prevent the buckling of the thermal developing recording material. A feeding roller pair and a discharge roller pair which are thermal developing recording material transfer means are provided on both ends of the thermal developing recording material delivery path.

For the pressing roller 183, a metal roller, a resin roller and a rubber roller can be utilized and the thermal conductivity of the pressing roller 183 is suitably set to 0.1 to 200 W/m/° C. Moreover, it is preferable that a heat insulating cover for heat insulation should be provided in a position on the opposite side of the plate heater 181 with the pressing roller 183 seen as a center.

As a matter of course, the curved plate heater is illustrated as an example and may be constituted to comprise an endless belt and a separating click by using another flat plate heater and a heating drum.

The thermal developing recording material discharged from the thermal developing section 18 is cooled carefully so as not to generate a wrinkle and to make a strange curl by the cooling section 20. The thermal developing recording material discharged from the cooling section 20 is guided to the guide plate by means of the delivery roller pair and is collected from the discharge roller pair to a tray 22.

The cooling section 20 includes a plurality of cooling rollers which are arranged to give a desirable constant curvature R in the thermal developing recording material delivery path. This implies that the thermal developing recording material is delivered with the constant curvature R until it is cooled to the glass transition point of the material or less. By intentionally giving the curvature to the thermal developing recording material, thus, an unnecessary curl is not made before the thermal developing recording material is cooled to the glass transition point or less. A new curl is not made at the grass transition point or less so that a curl amount is not varied.

Moreover, the temperatures of the cooling roller itself and the internal atmosphere of the cooling section 20 are regulated. By such a temperature regulation, states obtained immediately after the startup of the heat treating device and after sufficient running are set to be as identical as possible so that a fluctuation in a density can be reduced.

In the first embodiment of the invention, the thermal developing apparatus serves to correct the amount of recording light of a thermal developing recording material on the basis of the temperature of the pressing roller 183 in the thermal developing section 18.

For the temperature of the thermal developing section for correcting the light amount, it is preferable that the surface temperature of the pressing roller 183 should be measured. In order to measure the surface temperature of the pressing roller 183, moreover, a thermal element such as a thermistor may be caused to come in contact with the surface of a heat roller to measure the temperature and an infrared sensor is preferably used as a device for carrying out an accurate and rapid measurement. The infrared sensor is a measuring element of a non-contact type which serves to output a signal corresponding to an infrared ray radiated from a measured member and has such an advantage that it is contaminated with difficulty and does not damage a measuring object. For the infrared sensor of this type, for example, a device described in JP-A-60-51872 has been known.

For the temperature of the thermal developing section, moreover, it is also possible to use ① the surface temperature of the pressing roller in the thermal developing section, and furthermore, ② the temperature of air in the vicinity of a thermal developing recording material passing portion in the thermal developing section and ③ the temperatures of the thermal developing section and other members. However, the detection of the surface temperature of the pressing roller in the thermal developing section can detect the temperature of the thermal developing recording material more accurately, which is preferable.

In FIG. 1, there is provided a temperature sensor B1 for measuring the surface temperature of the pressing roller in the thermal developing section in ①.

A light amount correcting circuit A1 of the control section A controls the output of the laser of an exposing unit 162 based on the output of the temperature sensor B1, thereby correcting the amount of the exposed light of the thermal developing recording material.

Figure 2:
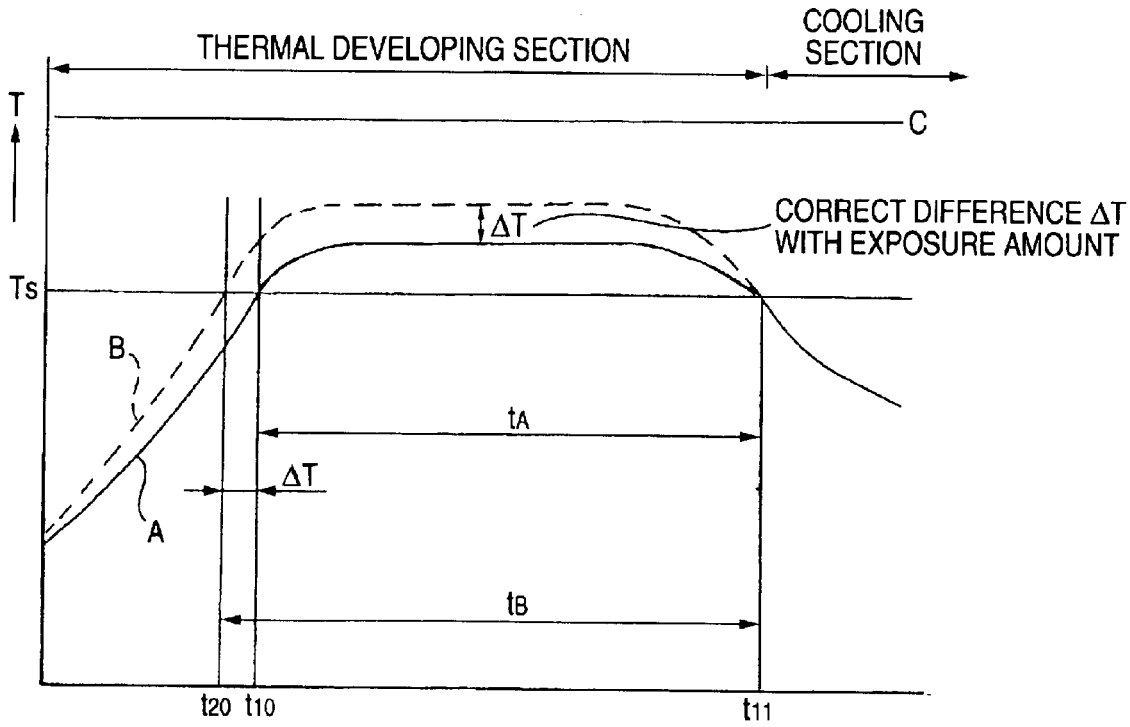
FIG. 2 is a chart showing a transition of a temperature versus a time at a point on a thermal developing recording material until the thermal developing recording material enters and gets out of a thermal developing section, illustrating a correcting way according to a first embodiment of the invention.

For a method of correcting the amount of the exposed light of the thermal developing recording material, the light amount is reduced when the temperature of the thermal developing section is increased. The reason is as follows. When the temperature of the thermal developing section is increased, a time that the developing start temperature of the thermal developing recording material is reached becomes increasingly earlier and the development temperature of the thermal developing recording material is increased, and a density is increased in that condition. Herein, a difference ΔT in a rise in the temperature is corrected by the amount of exposure. This can be understood from the temperatures such as $t_{10} \rightarrow t_{20}$, +ΔT in FIG. 2, where $t_{10}$ stands for developing start time of thermal developing recording material A, $t_{20}$: developing start time of thermal developing recording material B, $t_{11}$: developing stop time of thermal developing recording material, $t_A$: developing progress period of thermal developing recording material A, $t_B$: developing progress period of thermal developing recording material B, $t_S$: thermal developing start temperature, and C: heating member temperature.

In the foregoing, a time required for the movement of the thermal developing recording material from the recording section to the thermal developing section is not taken into consideration and is not so short that a time to temperature change in the thermal developing section influences the thermal developing recording material, and a distance from the recording section to the thermal developing section is short. For this reason, a next thermal developing recording material can be fed back immediately. Thus, practical use can sufficiently be realized.

Figure 3:
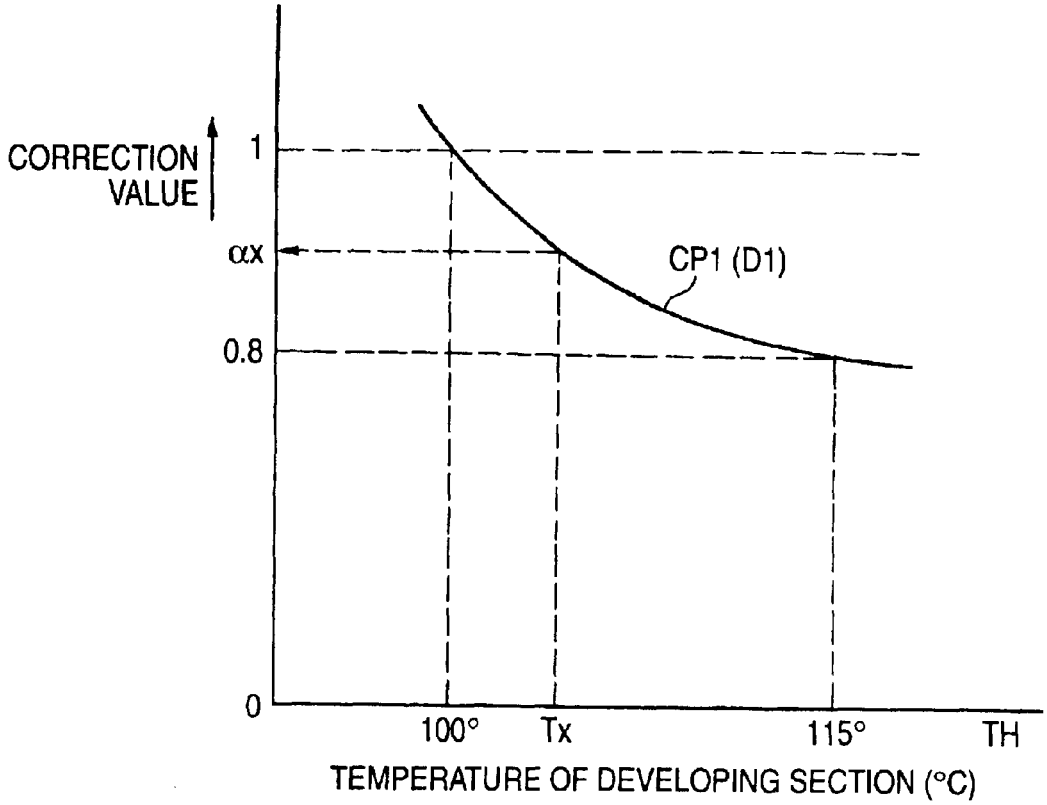
FIG. 3 is a graph showing a correction value versus the temperature of the thermal developing section according to the first embodiment.

Description will be given to a method of determining the correction value of a recording light amount according to the first embodiment of the invention. A correction value αx at a certain temperature Tx to be a temperature TH in the thermal developing section is determined in the following manner with reference to FIG. 3. FIG. 3 shows an example of a graph indicative of a correction value versus a temperature in the thermal developing section. In FIG. 3, a correction curve CP1 is obtained by plotting data taken previously by an experiment for a reduction in a recording light amount to carry out thermal development in the same density when the temperature TH of the thermal developing section is changed in the case of a density D1. For example, on the assumption that a correction value=1 is set at 100° C. and the temperature of the thermal developing section is raised, the correction value is gradually decreased and a correction value=0.8 is obtained at 115° C. as shown in the drawing. Thus, there is determined the correction curve CP1 (in the case of the density D1) for carrying out a correction to reduce the light amount when the temperature of the thermal developing section is raised.

When the temperature of the thermal developing section is set to Tx (° C.), the correction value αx can be calculated by using the CP1 curve. An amount L1 of corrected light can be calculated by an equation 3, wherein a precorrection light amount is represented by L0.

$$L1=\alpha x \times L0 \quad \text{(Equation 3)}$$

Recording is preferably carried out in the amount L1 of the corrected light.

By such a correction, even if the thermal developing section is changed to have various temperatures, the density can be stabilized.

Moreover, the correction value also forms the function of the density. If the temperature of the thermal developing section is constant, the correction value α is to be decreased when the density D for recording is increased.

Figure 4:
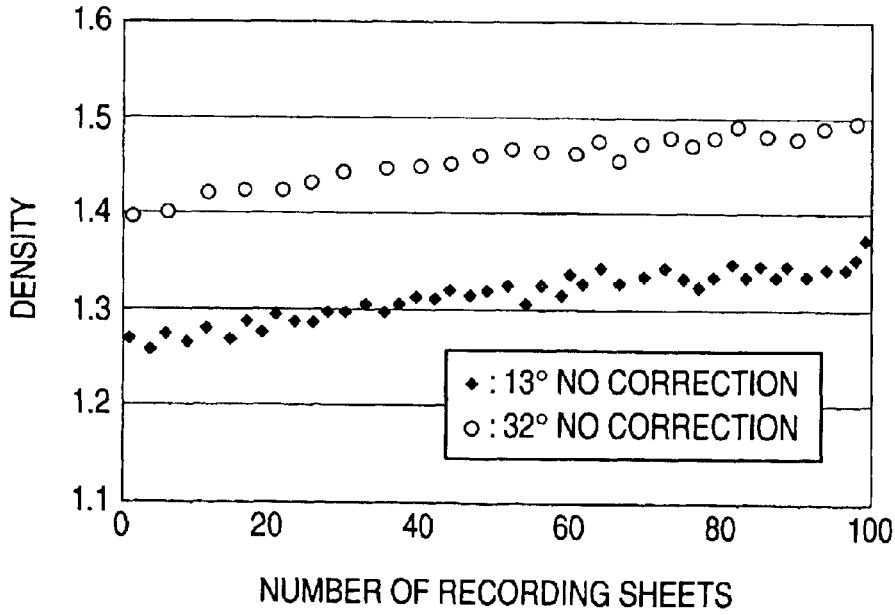
FIG. 4 is a chart showing a transition of a density versus the number of thermal developing recording material recorded sheets in a conventional apparatus (in the case in which a temperature is not corrected)
Figure 5:
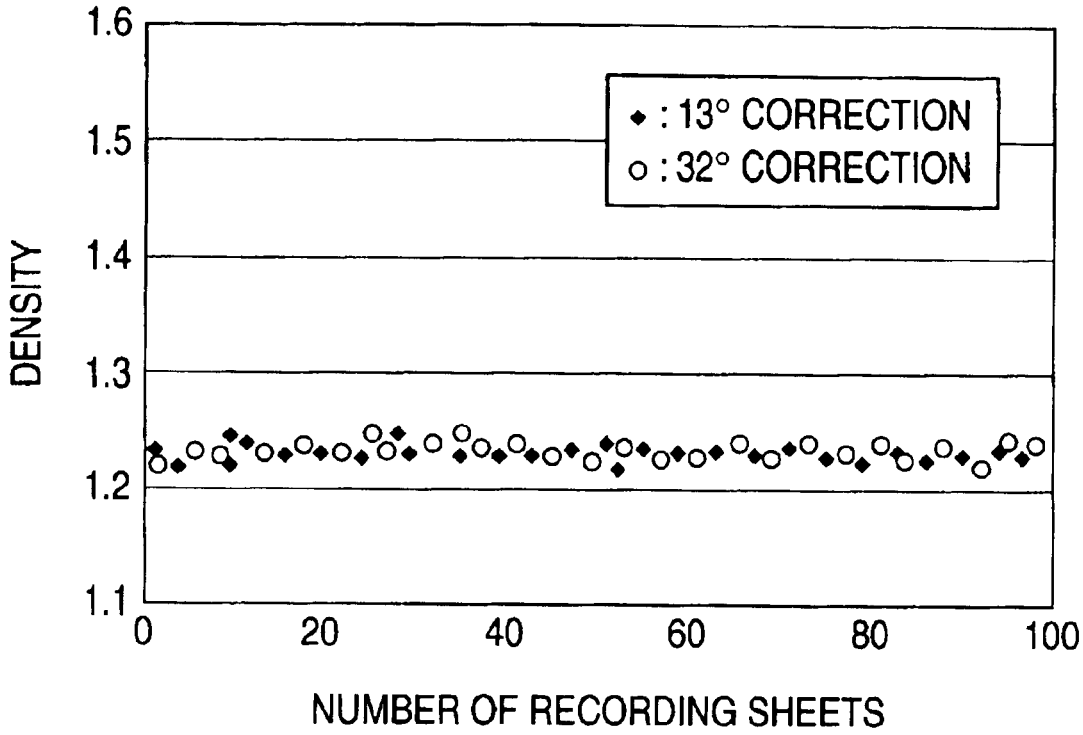
FIG. 5 is a chart showing a transition of a density versus the number of thermal developing recording material recorded sheets in the apparatus according to the invention (in the case in which the temperature is corrected)

FIG. 4 is a chart showing the transition of a density versus the number of thermal developing recording material recorded sheets in a conventional apparatus (in the case in which a temperature correction is not carried out), and FIG. 5 is a chart showing the transition of a density versus the number of thermal developing recording material recorded sheets in the apparatus according to the invention (in the case in which the temperature correction is carried out).

Moreover, "◆" indicates the case in which an ambient temperature is 13° C. and "○" indicates the case in which the ambient temperature is 32° C. Referring to FIG. 4, it is apparent that the density is rapidly increased at the ambient temperature of 13° C. and 32° C. when the number of thermal developing recording material recorded sheets is increased.

On the other hand, it is apparent that the density is always constant at the ambient temperature of 13° C. and 32° C. even if the number of thermal developing recording material recorded sheets is increased in FIG. 5.

Figure 6:
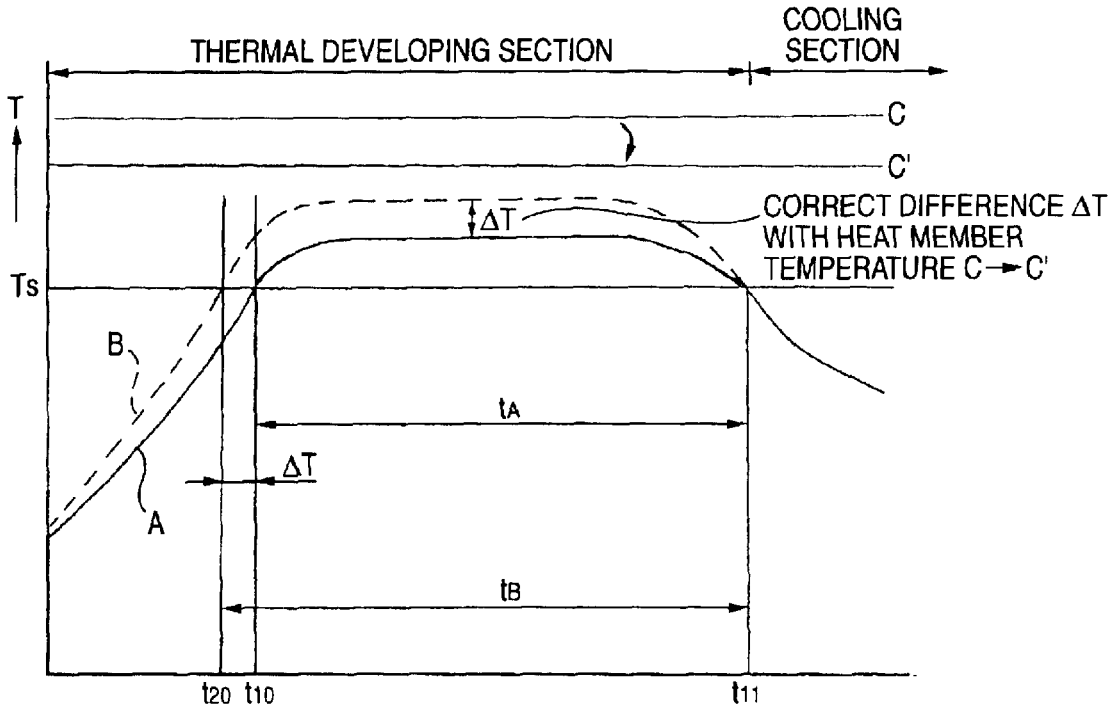
FIG. 6 is a chart showing a transition of a temperature versus a time at a point on a thermal developing recording material until the thermal developing recording material enters and gets out of a thermal developing section, illustrating a correcting way according to a second embodiment of the invention.

While the amount of the exposed light of the thermal developing recording material is corrected from the surface temperature of the pressing roller in the thermal developing section in the first embodiment of the invention, the temperature of a heating member is corrected from the surface temperature of the pressing roller in the thermal developing section in a second embodiment which will be described below. A heating member temperature correcting circuit A2 of a control section A serves to control the temperature of a heating member 183 of a thermal developing section 18 to correct the development temperature of a thermal developing recording material based on the output of the temperature sensor B1. FIG. 6 is a chart showing the transition of a temperature versus a time at a point on a thermal developing recording material while the thermal developing recording material enters and gets out of the thermal developing section, illustrating how to carry out a correction according to the second embodiment of the invention. In FIG. 6, when the temperature of the thermal developing section is more raised, the thermal developing recording material reaches a developing start temperature earlier and the development temperature of the thermal developing recording material is more raised. In that condition, a density is increased. Therefore, the correction is carried out corresponding to an increase (that is, a difference) ΔT in a temperature in order to drop a temperature C of a heating member 181 to a temperature C' after the correction. This can be understood from temperatures such as $t_{10} \rightarrow t_{20}$, +ΔT in FIG. 6, where $t_{10}$ stands for the developing start time of thermal developing recording material A, $t_{20}$: developing start time of thermal developing recording material B, $t_{11}$: developing stop time of thermal developing recording material, $t_A$: developing progress period of thermal developing recording material A, $t_B$: developing progress period of thermal developing recording material B, $t_S$: thermal developing start temperature, and C: heating member temperature.

Figure 7:
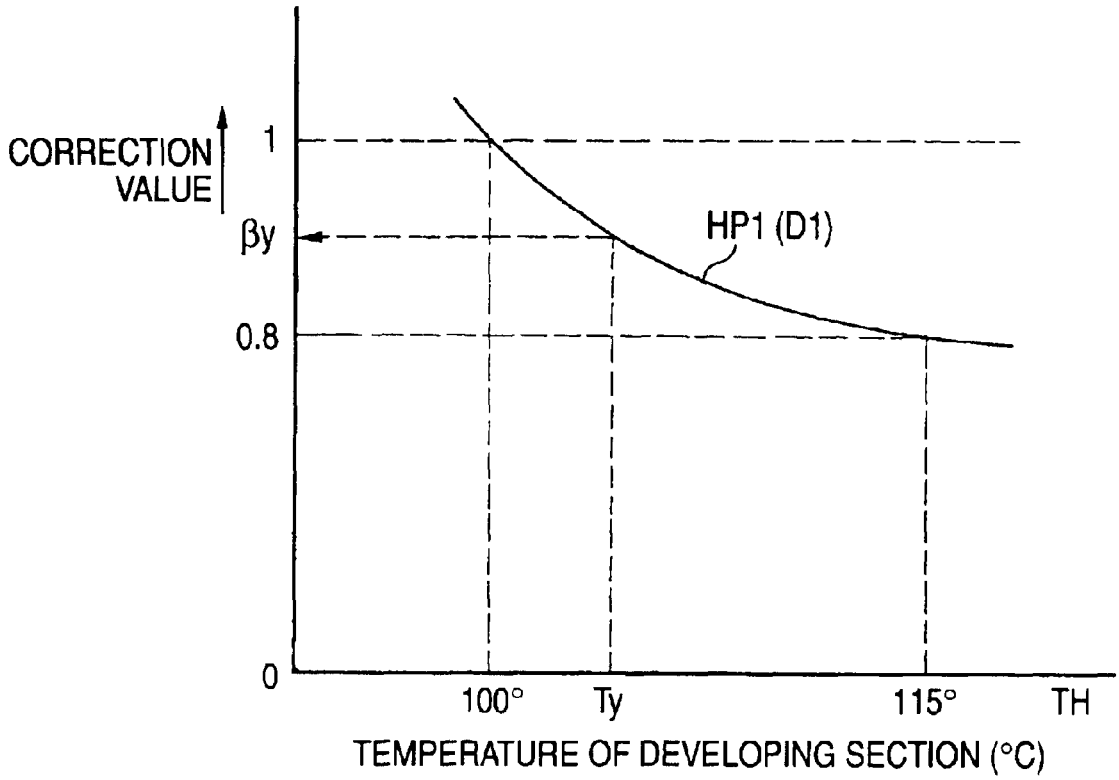
FIG. 7 is a graph showing a correction value versus the temperature of the thermal developing section according to the second embodiment, FIGS. 8(*a*) and 8(*b*) show the flowcharts for printing in an emergent mode at time of the uncompletion of heat-up according to a third embodiment of the invention.

With reference to FIG. 7, description will be given to the way of determining the correction value of the temperature of the heating member according to the second embodiment of the invention. FIG. 7 shows an example of a graph indicating a correction value versus a temperature of a thermal developing section. In FIG. 7, a correction curve HP1 is obtained by plotting data taken previously by an experiment as to a reduction in the temperature of the heating member of the thermal developing section to carry out thermal development in a certain density D1 when a temperature TH of the thermal developing section is changed. For example, a correction value=1 is set at 100° C. as shown. It is assumed that the correction value is gradually decreased and the correction value=0.8 is obtained at 115° C. when the temperature of the thermal developing section is raised. Thus, when the temperature of the thermal developing section is raised, the correction curve HP1 (in the density D1) for carrying out a correction to drop the temperature of the heating member is determined.

When the temperature of the thermal developing section is Ty (° C.), a correction value βy can be obtained by using the HP1 curve. Assuming that the temperature of the heating member before the correction is represented by C, a temperature C' of the heating member after the correction can be obtained by an equation 4.

$$C' = \beta y \times C \qquad \text{(Equation 4)}$$

Accordingly, if the thermal development is carried out at the temperature C' of the heating member, the density becomes constant.

Also in the second embodiment of the invention, thus, in the case in which the thermal developing section is changed to have various temperatures, the density can be stabilized.

Moreover, the correction value also forms a function of the density. In the case in which the temperature of the thermal developing section is constant, the correction value β is to be decreased when the density D for recording is increased.

By using the correcting method according to the second embodiment described above, an experiment was conducted for a transition of the relationship between the number of thermal developing recording material recorded sheets and a change in the density at an ambient temperature of 13° C. and 32° C. Even if the number of the thermal developing recording material recorded sheets is increased, the density is always constant at the ambient temperature of 13° C. and 32° C. It was confirmed that the same result as that in FIG. 5 can be obtained.

For the thermal developing recording material, DI-ALEm. No. 51151 (an expiration date: December, 2003) produced by Fuji Photo Film Co., Ltd. was used.

Figure 8:
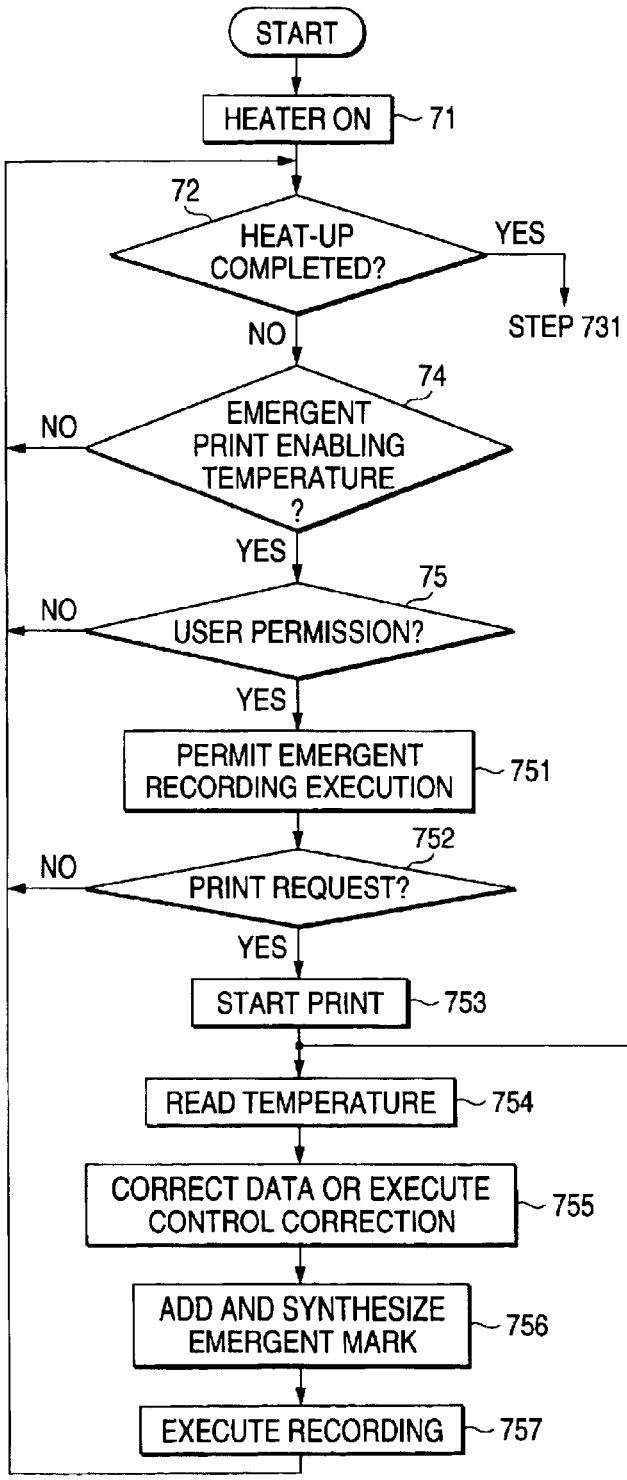
Figure 8:
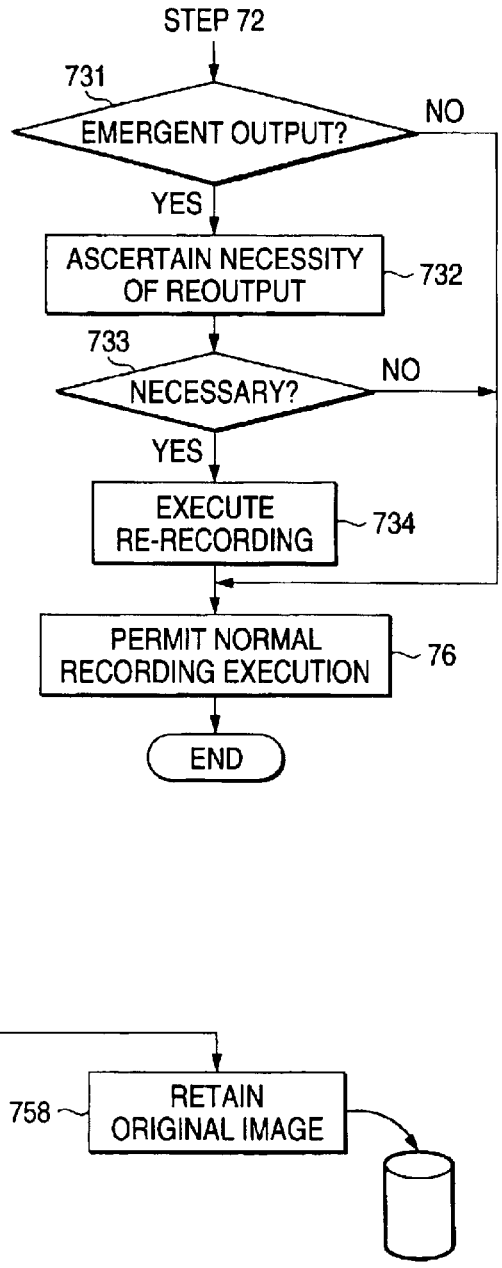

FIG. 8 shows a third embodiment of the invention and is a flow chart for a printer according to the third embodiment. In the third embodiment, a print processing can be permitted to be started in response to the instruction of a user in an emergent mode before predetermined heat-up is completed.

A heater is turned ON at a step 71 and it is decided whether the heat-up is completed or not at a step 72. If the decision is Yes (the heat-up is completed), the processing proceeds to a step 731 and subsequent steps in a flow (b).

On the other hand, if the decision is No (the heat-up is not completed) at the step 72, the processing proceeds to a step 74 to be an emergent mode step according to the invention. At the step 74, it is decided whether or not a temperature at which emergent printing can be carried out is reached. If a predetermined temperature at which the emergent printing can be carried out is not reached, the processing returns to the step 72.

At the step 74, it is decided whether or not the predetermined temperature at which the emergent printing can be carried out is reached. Instead, it may be decided whether the predetermined temperature at which the emergent printing can be carried out is not reached at the present time and the same predetermined temperature can be expected to be reached during development. Consequently, even if the temperature at which the emergent printing can be carried out is not reached at the present time, it is sufficient that the same temperature is reached when a film arrives at the thermal developing section. Such a condition is desired because a time can further be shortened.

If the temperature at which the emergent printing can be carried out is reached at the step 74, it is decided whether the permission of a user is given or not at a step 75. If the permission is not given, the processing returns to the step 72. Subsequently, this loop is repeated to wait for the permission or the completion of the heat-up.

If the permission of the user is given at the step 75, a recording execution permission is given at a step 751. If a print request is given at a step 752, printing is started at a step 753. If the print request is not given at the step 752, the processing returns to the step 72.

If the print is started at the step 753, the temperature of the thermal developing section is read at a step 754. Based on the result of the reading, a data correction or a control correction which will be described below is executed at a step 755, an emergent mark is added and synthesized at a step 756 as will be described below, and image recording is executed at a step 757.

At the same time, an original image is stored in a hard disk at a step 758.

The image recording is executed at the step 757 and the processing is then returned to the step 72 again. If the heat-up is not completed at the step 72, the processing proceeds to the emergent mode step 74 again and the permission of the user is given at the step 75 to reach the step 752. If the printing is once carried out in the emergent mode and is not required any more, no request is given and the processing then returns to the step 72. Subsequently, this loop is repeated to wait for the completion of the heat-up.

If the heat-up is completed at the step 72, the processing proceeds to the step 731 and subsequent steps in the flow of FIG. 8(*b*). In the flow chart of FIG. 8(*b*), the user is once asked about reoutput if emergent output has already been carried out at the steps 731 to 734. At the step 731, it is decided whether the emergent output has already been carried out or not. If the emergent output is not completed (No), the processing proceeds to a step 76 in which normal recording execution is permitted.

On the other hand, if the emergent output is completed (Yes), the processing proceeds to the step 732 in which the necessity of the reoutput is ascertained. If the reoutput is not required (No), the processing proceeds to the step 76. If the reoutput is required (Yes), the processing proceeds to the step 734 in which re-recording is executed. Thereafter, the processing proceeds to the step 76. At the step 76, the normal recording execution is permitted to carry out a transition to a recording mode. The subsequent flow usually has variations and will be omitted. Finally, the flow is ended.

As described above, at the steps 74 to 753, even if the temperature of the thermal developing section does not reach the developing start temperature, image recording can be executed by the instruction of the user when the temperature of the thermal developing section which is sufficient for a diagnosis has already been reached or the temperature of the thermal developing section which is sufficient for the diagnosis can be excepted to be reached at time of the development. Consequently, the time can be shortened more greatly than that in a conventional apparatus.

In that case, the correction for increasing the amount of exposure by a recording section is carried out at the step 755 corresponding to a reduction in a density which is caused by the uncompletion of the heat-up. Therefore, it is possible to obtain an image which can be seen more easily at time of the uncompletion of the heat-up.

As a result of the image recording started when the heat-up is uncompleted, furthermore, a mark indicative of image recording for the uncompletion of the heat-up is given to the output film at the step 756. Consequently, a person himself (herself) does not need to memorize the purport for future reference. Furthermore, when seeing the same film, a third person that does not know the purport can be prevented from excessively worrying about the failures of the developing device.

Referring to the image recording started when the heat-up is uncompleted, moreover, the reoutput may be automatically carried out or the user may be asked about the reoutput at the step 731 and subsequent steps to carry out the reoutput if the user gives a request for the reoutput. Since an original film of high picture quality for the future can also be obtained in addition to an emergent output film acquired at the time of the uncompletion of the heat-up, thus, the image recording is convenient.

Figure 9:
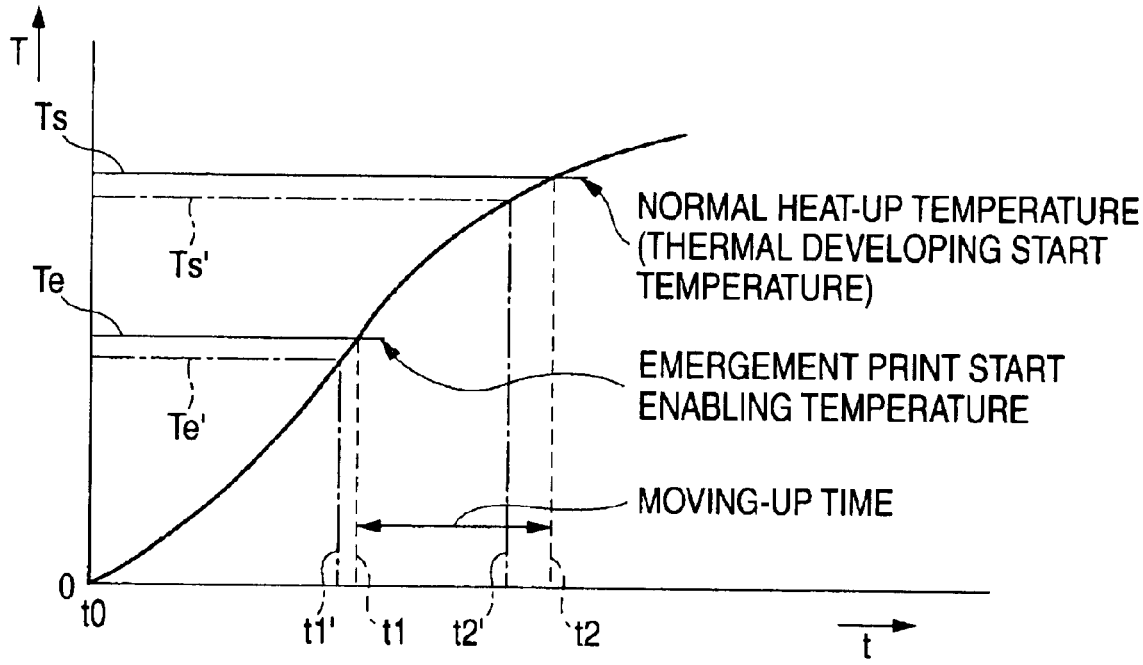
FIG. 9 is a graph showing the relationship between the temperature of a thermal developing section versus a time taken from the power ON of a recording device.

FIG. 9 is a graph showing a temperature in the thermal developing section versus a time taken from the power ON (start) of a recording device, in which t2 indicates a time (usually, approximately 30 minutes) taken from a start (t0) to a normal heat-up temperature (a developing start temperature) Ts and t1 indicates a time (usually, approximately 20 minutes) taken from the start (t0) to an emergent print start enabling temperature Te. A time (approximately 10 minutes) of (t2–t1) can be shortened in the invention.

For a period required for reaching the emergent print start enabling temperature Te, moreover, an image can rarely be recorded on a film. Therefore, it is assumed that the emergent print is not carried out for this period.

Furthermore, Te' indicates a current temperature at which the emergent print start enabling temperature Te can be expected to be reached during development. The time is indicated as t1'. Even if the temperature of the thermal developing section does not reach the emergent print start enabling temperature Te at the present time, it is sufficient that the same temperature is reached during the development. For this reason, it is preferable that the recording should be started at the temperature Te' on t1'. Thus, the time can further be shortened.

In addition, Ts' indicates a current temperature which can be expected to reach a thermal development starting temperature Ts. The time is indicated as t2'. The start time is set onto a time t2' in predictive control expecting that a heat-up section completes heat-up in the invention described in JP-A-7-125295.

As is thus apparent from FIG. 9, according to the invention, (1) the recording is started at the time t1 before predetermined heat-up is completed. Therefore, a time can be shortened more greatly as compared with the recording start time t2 in a conventional apparatus. As compared with a recording start time t2' in the invention described in the JP-A-7-125295, similarly, a time can be shortened more greatly.

If the recording is started at the time t1' at which the emergent print enabling temperature can be expected to be reached, furthermore, the time can be shortened still more.

In the case in which the printing is to be carried out before the predetermined heat-up is completed, the invention carries out the correction to prevent a deterioration in picture quality such as a reduction in a density which is caused by the uncompletion of the heat-up in image data themselves or an image recording method.

Consequently, the amount of recording light of the thermal developing recording material in the recording section is corrected based on the temperature of the thermal developing section at time of the heat-up uncompleted recording. As a light amount correcting method in that case, (A) it is supposed that a constant light amount is uniformly added to a predetermined light amount irrespective of the density of a recorded pixel. More specifically, in this correcting method, the amount of light to be corrected is uniformly increased if the temperature of the thermal developing section is low irrespective of the density of a recorded image, and is uniformly decreased as the temperature of the thermal developing section approximates to the thermal developing start temperature. This correcting method is convenient and an output film which is obtained can be prevented from being exposed insufficiently, and has a sufficient density even if picture quality is slightly deteriorated. Therefore, the output film can be seen much more greatly and can be diagnosed more easily than an unexposed output film.

(B) In addition to the correcting method of (A), there is proposed a correcting method to take a density into consideration. More specifically, in this correcting method, the amount of light to be corrected is decreased for a recorded pixel having a low density at the predetermined temperature of the thermal developing section and is increased as the density becomes higher, and furthermore, the whole amount of light to be corrected is increased if the predetermined temperature of the thermal developing section is low, and is decreased as the temperature of the thermal developing section approximates to the thermal developing start temperature. In the case in which the densities of the recorded pixels are equal to each other, accordingly, the amount of light to be corrected is increased if the predetermined temperature of the thermal developing section is low, and is decreased if the temperature of the thermal developing section is high. In the case in which the temperature of the thermal developing section is equal, the amount of light to be corrected is decreased if the density of the recorded pixel is low, and is increased if the density of the recorded pixel is high. These correction values can be achieved in the following manner. A table for filling an intersecting point with a correction coefficient in a thermal developing section temperature versus each recorded pixel density table shown in FIG. 10 is prepared, a control section refers to the table based on density information about the current temperature of the thermal developing section which is sent from a temperature sensor and density information about a pixel for recording an image, thereby acquiring the correction coefficient, and a recording section is caused to carry out recording in a light amount corrected by a value obtained from a multiplication of a predetermined light amount by the correction coefficient FIG. 10 shows an example of a correction coefficient table indicative of each correction coefficient in case of an image density versus a temperature in the thermal developing section. In FIG. 10, an axis of ordinate divides an image density of highlight to shadow into 24 points. An axis of abscissa indicates a part of the temperature of the thermal developing section. A recording light amount obtained by multiplying an original recording light amount by a correction coefficient is represented in order to carry out thermal development in a certain density at a certain temperature in the thermal developing section. For example, the correction coefficient for recording a density of 16 is 1.41 at a temperature in the thermal developing section of 100° C. Accordingly, it is sufficient that exposure is carried out with a value obtained by an original recording light amount by 1.41. Similarly, a correction coefficient for recording a density of 10 is 1.29 at a temperature in the thermal developing section of 100° C. According to the table of FIG. 10, thus, recording for heat-up uncompleted recording is shown. For this reason, although the density is originally insufficient, the amount of light is increased to raise the density also in a pixel portion having a low density and the amount of light is increased still more to fully raise the density in a pixel portion having a high density. Even in the recording carried out during the heat-up uncompleted recording, consequently, it is possible to obtain a recorded film which can fully be viewed.

It is preferable that an indication of print started before predetermined heat-up, for example, an indication of "print before heat-up" should be given to a film output as a result of printing started before the predetermined heat-up is completed.

Figure 11:
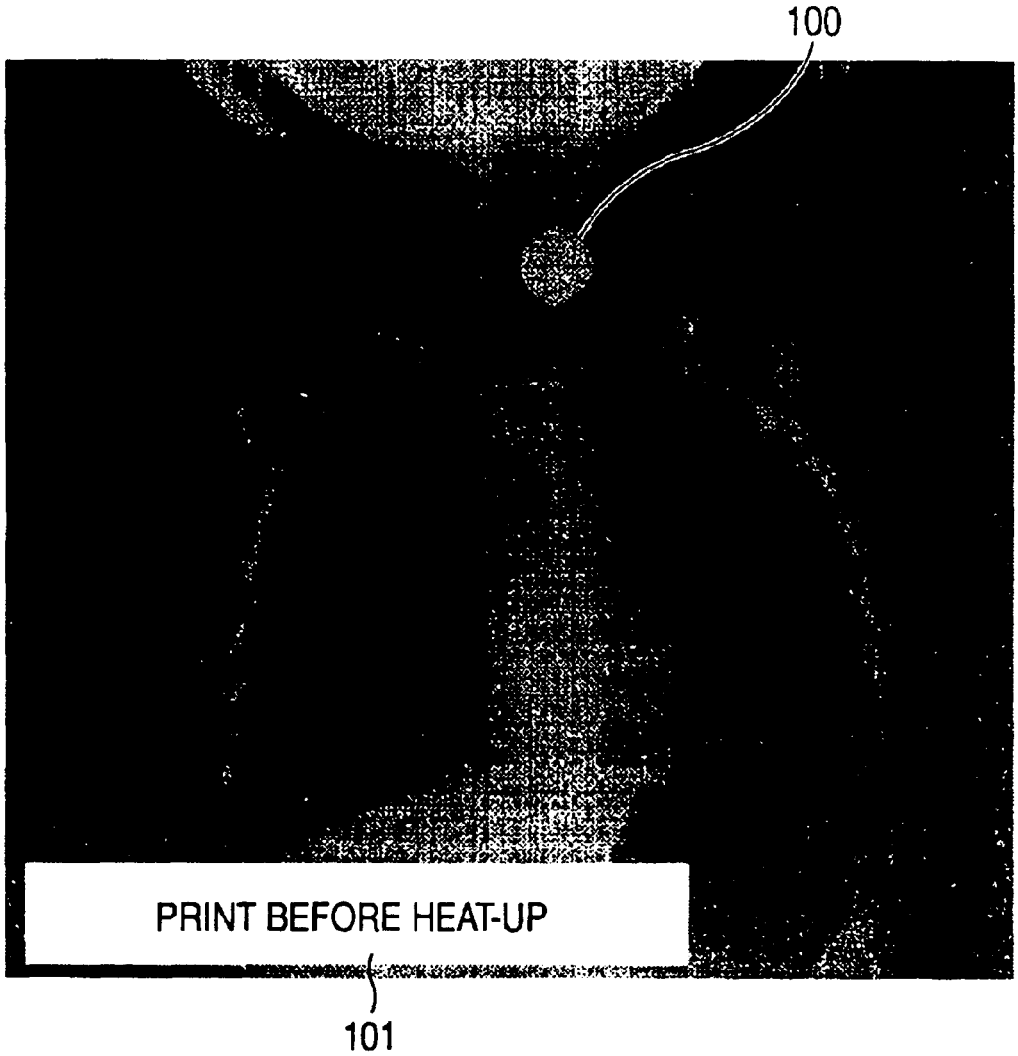
FIG. 11 is a view showing an X-ray film image having a display indicative of the purport that emergent printing is carried out.

FIG. 11 shows an image indicating an X-ray film in which an infant swallows a foreign substance (for example, a coin of one hundred yen) by mistake. In FIG. 11, 100 denotes a foreign substance and 101 denotes a display indicative of print started before heat-up. According to the invention, in case of emergency in which there is not a moment to lose, and furthermore, when such picture quality as to specify the position of the foreign substance is enough, the recording can be thus moved up, which is convenient. In addition, the purport that the print is started before the heat-up is thus displayed. Consequently, it is apparent that the film is obtained by printing with an agreement of a deterioration in picture quality. For this reason, a person himself (herself) does not forget the fact later. Moreover, a third person which does not know this fact can understand the purport from the film. Therefore, the third person can be prevented from excessively worrying about the deterioration in a film or the failure of a printer.

Furthermore, it is also preferable that the degree of the heat-up should be displayed. For example, an indication of "%" or "actual temperature/target temperature" is given. It is preferable that the size of the indication should be quietly reduced on an end or the indication should be remarkably given to the vicinity of an observing portion. It is preferable that the print start should be always permitted with the heat-up uncompletion.

As described above, the printing is started by the predetermined operation of a user before the predetermined heat-up is completed. Consequently, a recording start waiting time can be shortened corresponding to a heat-up time. In case of an emergent medical treatment, a great advantage can be produced. In addition, it is possible to minimize a deterioration in picture quality by correcting the uncompleted heat-up as described above. Furthermore, it is possible to obtain a result with precise picture quality by executing the reoutput selection after the completion of the heat-up.

By using a film in which the degree of the heat-up rarely causes a deterioration in the picture quality, for example, a film having a low temperature dependency, it is possible to further shorten a substantial heat-up time.

As is apparent from the above description, the density is rapidly raised when the number of the thermal developing recording material recorded sheets is increased in the conventional apparatus. On the other hand, in the thermal developing apparatus according to the invention, the temperature of the thermal developing section is measured and the amount of recording light of the thermal developing recording material and/or the temperature of the heating member are/is corrected based on the measured value. Even if the temperature of the thermal developing section is changed variously, therefore, the density is always maintained to be constant.

Moreover, the printing is started by the predetermined operation of a user before the heat-up is completed. Consequently, a recording start waiting time can be shortened corresponding to a heat-up time. In case of an emergent medical treatment, a great advantage can be produced. In addition, it is possible to minimize a deterioration in picture quality by executing the correction corresponding to the uncompleted heat-up, and furthermore, it is possible to obtain a result with precise picture quality by executing the reoutput selection after the completion of the heat-up.

What is claimed is:

1. An image recording method of a thermal developing apparatus, in which a recording section for exposing a thermal developing recording material including a thermal developing photosensitive material or a photosensitive thermal recording material, to form a latent image, a control section for controlling the recording section, and a thermal developing section for heating the thermal developing recording material by a heating member to carry out thermal development are provided, comprising the steps of;

measuring a temperature of the thermal developing section, and correcting an amount of recording light used to expose the thermal developing recording material of the recording section based on a temperature of the thermal developing section.

2. A thermal developing apparatus, having a recording section for exposing a thermal developing recording material to form a latent image, a control section for controlling the recording section, and a thermal developing section for heating the thermal developing recording material by a heating member to carry out thermal development, comprising:

a thermal developing section temperature sensor for measuring a temperature of the thermal developing section; and a light amount correcting circuit for correcting an amount of recording light used to expose the thermal developing recording material of the recording section based on a temperature of the heating member of the thermal developing section.

3. The thermal developing apparatus of claim 2, further including a heating member temperature correcting circuit for correcting a temperature of the heating member of the thermal developing section.

4. The image recording method of a thermal developing apparatus according to claim 1, further including correcting a temperature of the heating member of the thermal developing section based on a temperature of the thermal developing section.

5. An image recording method of a thermal developing apparatus, in which a recording section for exposing a thermal developing recording material to form a latent image, a control section for controlling the recording section, and a thermal developing section for heating the thermal developing recording material by a heating member to carry out thermal development are provided, the method comprising:

determining that a temperature of the thermal developing section has not reached a predetermined developing start temperature and a) that temperature of the thermal developing section which is lower than the predetermined start temperature and can give a sufficient density for a diagnosis has already been reached or b) the temperature of the thermal developing section which is enough for the diagnosis can be expected to be reached at time of development; and executing image recording in response to an instruction of a user before the predetermined start temperature has been reached by the thermal developing section.

6. The image recording method of a thermal developing apparatus according to claim 5, wherein a correction for increasing an amount of exposure by the recording section is carried out corresponding to an expected reduction in a density which is caused by the thermal developing section not reaching the predetermined start temperature.

7. The image recording method of a thermal developing apparatus according to claim 6, wherein a display indicative of image recording at a time before the thermal developing section has reached the predetermined developing start temperature is given to an output film.

8. The image recording method of a thermal developing apparatus according to claim 5, wherein a display indicative of image recording at a time before the thermal developing section has reached the predetermined developing start temperature is given to an output film.

9. The image recording method of a thermal developing apparatus according to claim 8, wherein a print output started before the predetermined start temperature has been reached can be reoutput automatically or in response to a request of a user after the predetermined start temperature has been reached.

10. The image recording method of a thermal developing apparatus according to claim 5, wherein a print output started before the predetermined start temperature has been reached can be reoutput automatically or in response to a request of a user after the predetermined start temperature has been reached.

* * * * *